US006101919A

United States Patent [19]

Murello

[11] Patent Number: 6,101,919

[45] Date of Patent: Aug. 15, 2000

[54] INTERLOCKED FIREARM

[75] Inventor: Johannes Murello, Eckhofstrasse, Germany

[73] Assignee: Heckler & Koch GmbH, Oberndorf/Neckar, Germany

[21] Appl. No.: 09/054,058

[22] Filed: Apr. 2, 1998

[30] Foreign Application Priority Data

Apr. 4, 1997 [DE] Germany ..... 197 13 988

[51] Int. Cl.[7] ..... F41A 3/26

[52] U.S. Cl. ..... 89/188; 42/16; 42/25

[58] Field of Search ..... 89/184, 185, 187.01, 89/188, 171, 172, 173, 174; 42/16, 25

[56] References Cited

U.S. PATENT DOCUMENTS

| | | | |
|---|---|---|---|
| 3,690,218 | 9/1972 | Maillard | 89/185 |
| 3,696,542 | 10/1972 | Ekfeldt et al. | 42/16 |
| 4,022,105 | 5/1977 | White | 89/185 |
| 4,563,937 | 1/1986 | White | 89/185 |
| 4,655,118 | 4/1987 | Bruderer et al. | 89/185 |
| 5,447,092 | 9/1995 | Dobbins | 89/187.02 |
| 5,458,046 | 10/1995 | Blenk et al. | 42/16 |

FOREIGN PATENT DOCUMENTS

| | | | |
|---|---|---|---|
| 15 78 392 | 5/1971 | Germany . | |
| 24 43 044 | 4/1975 | Germany . | |
| 2418915 | 10/1975 | Germany | 42/16 |

*Primary Examiner*—Stephen M. Johnson
*Attorney, Agent, or Firm*—Marshall, O'Toole, Gerstein, Murray & Borun

[57] ABSTRACT

A sleeve made of spring plate is positioned between the mushroom head and the breechblock carrier of a locked firearm. The sleeve is supported in the expanded state between the mushroom head and the breechblock carrier and, thus, prevents their being pushed together. During closure of the breechblock, the sleeve enters a fixed cone which compresses it radially in elastic fashion so that the sleeve can be inserted into an annular space in the mushroom head and/or the breechblock carrier. The radial compression of the sleeve permits the mushroom head and the breechblock carrier to be pushed together and, thus, permits relative rotation between the mushroom head and the breechblock carrier.

32 Claims, 2 Drawing Sheets

INTERLOCKED FIREARM

FIELD OF THE INVENTION

The invention relates generally to firearms and, more particularly, to an interlocked firearm having a breechblock comprising a mushroom head and a breechblock carrier.

BACKGROUND OF THE INVENTION

In prior art breechblocks, the connection device between the mushroom head and the breechblock carrier forms, in the simplest case, a neck which is rigidly connected, for example, to the mushroom head and which can be pushed telescope-like into the breechblock carrier by the length of the locking distance when the breechblock is locked. However, this type of neck can also be formed on or rigidly connected to the breechblock carrier. In such an instance, the neck can be inserted into the mushroom head. Alternatively, the neck may optionally be formed from a separate part that can be inserted into both the mushroom head and the breechblock carrier.

Typically, the firearm employing the breechblock will include a locking element. The locking element is arranged fixed on the barrel. The locking element is engaged by the mushroom head when the breechblock is locked so that the recoil exerted on the mushroom head by a fired cartridge does not move the mushroom head back to a significant degree (at least not instantaneously).

Engagement between the mushroom head and the locking element can occur by means of rolls that can be swung out radially, by blocks that can be swung out radially, or by flaps or the like. Nowadays, locking mostly occurs by turning the mushroom head, which is provided with several breech pins, so that the breech pins of the head engage behind counter-pins fixed in the locking element. In such an approach, automatic control of the mushroom head occurs through a guide link which operates between the mushroom head and the breechblock carrier and by support of the mushroom head in the weapon housing so that the mushroom head can only be turned when it is in its frontmost position.

Conventionally, in automatic weapons two opposite locking pins are situated in one radial plane and, optionally, at least one additional locking pin in another radial plane. However, it is also already known that several locking pins can be arranged in a single radial plane so that the mushroom head is similar in appearance to a drive shaft-gear, in which a tooth is missing at the sites prescribed for an extractor hook and/or an ejector.

Unlocking can be produced, for example, in a recoil-operated gun, by backward movement of the barrel and the entire breechblock over an initial distance. Such backward movement places the breechblock carrier in motion, subsequently rotates the mushroom head, carries out the loading movement, etc. However, a gas piston which is moved by the firing gases ejected from the barrel can also be used to in turn place the breechblock carrier in motion.

When the locking device is designed so that the mushroom head can execute a very limited backward movement during firing, then this backward motion can be applied to the breechblock carrier by a transfer mechanism, which in turn entrains the mushroom head (for example, the weapon G3).

If, in any of the described weapons, after the breechblock has been moved fully to the rear, the carrier is moved forward to feed a cartridge from a magazine or a belt device from the rear with the mushroom head, the mushroom head will be forced against the breechblock carrier in order to push the cartridge into the barrel. The forcing of the mushroom head against the breechblock carrier causes the automatic control mechanism to attempt to trigger the locking movement of the mushroom head. To prevent this locking movement from occurring, the mushroom head is guided in turn in guide tracks of the weapon housing. For example, if locking is caused by a pivotable block, the pivotable block is located to encounter a guide which prevents it from pivoting. In the common case of a rotatable mushroom head, this sits on guides that prevent its rotation.

However, in such an instance, the mushroom head and guide slide against each other under powerful mutual support so that wear is increased and the reliability of the weapon is reduced. In this regard, one need only think of the sand effect through which the uppermost cartridge in the magazine, which is forced against the magazine lip with greater force, sits even more strongly than usual. The sand effect also hampers sliding engagement between the mushroom head and guide.

This problem is addressed by German Patent No. 15 78 392 of the applicant in the special case of a semirigid, locked breechblock. The solution disclosed in that patent, however, entails several additional, precision-machined components and is, therefore, costly.

It is expressly pointed out that the ordinary longitudinal guides of the breechblock in the weapon housing are not affected by the described problem, since they need not take up any noticeable transverse forces.

SUMMARY OF THE INVENTION

In accordance with an aspect of the invention, a breechblock carrier is provided for use in a firearm having a barrel and a locking element formed at a proximal end of the barrel. The breechblock comprises a breechblock carrier and a mushroom head. It also includes a connecting device operatively coupling the breechblock carrier and the mushroom head; and an elastic sleeve mounted on the connecting device and having an expanded state and a compressed state. The elastic sleeve contacts the breechblock carrier and the mushroom head in the expanded state to thereby substantially prevent relative longitudinal movement between the mushroom head and the breechblock carrier. Compression of the sleeve from the expanded state towards the compressed state permits relative longitudinal movement between the breechblock carrier and the mushroom head.

In some embodiments, the barrel includes a cone at its proximal end such that, during closure of the breechblock, entry of the sleeve into the cone compresses the sleeve from the expanded state towards the compressed state. In such embodiments, either the mushroom head and the connecting device may define an annular space or the breechblock carrier and the connecting device may define the annular space. In either event, the sleeve is sized to enter the annular space when suitably compressed by the cone to permit relative longitudinal movement between the mushroom head and the breechblock carrier. Preferably, the sleeve prevents rotation of the mushroom head relative to the breechblock carrier when the sleeve is in the expanded state. Also preferably, the mushroom head can only be rotated relative to the breechblock carrier when the mushroom head is inserted a predetermined distance into the cone such that the sleeve has compressed sufficiently to permit longitudinal relative movement between the mushroom head and the breechblock carrier.

Preferably, the mushroom head engages behind the locking element in a locked position. In such embodiments, the breechblock is preferably unlocked by first proximally moving the breechblock carrier alone by a locking distance during which the mushroom head is rotated out of the locked position; and by thereafter moving the breechblock carrier and the mushroom head proximally together thereby causing the sleeve to move from the compressed state towards the expanded state. In such embodiments, when the sleeve is in the expanded state, the mushroom head and breechblock carrier can preferably be moved distally against a cartridge to reload without causing relative longitudinal movement between the mushroom head and the breechblock carrier. Also in such embodiments, the breechblock is preferably locked by first moving the breechblock carrier and the mushroom head together distally until the mushroom head reaches its distalmost position, and by subsequently moving the breechblock carrier distally by a locking distance such that the mushroom head rotates behind the locking element.

Other features and advantages are inherent in the apparatus claimed and disclosed or will become apparent to those skilled in the art from the following detailed description and its accompanying drawings.

BRIEF DESCRIPTION OF THE DRAWINGS

Certain advantages of the invention will now be further described with reference to the enclosed schematic drawings. Although a preferred embodiment of the invention is shown in the drawings, it is pointed out that, while the illustrated embodiment is preferred, it is in no way limiting to the scope of the invention.

In all of the figures the same variant is shown. Each reference number in each of the figures denotes the same element whose description with reference to one of the figures is also valid for all the others.

As used in the following description, "forward" is understood to mean the direction pointing to the muzzle of the weapon.

DESCRIPTION OF THE PREFERRED EMBODIMENTS

Figure 1A:
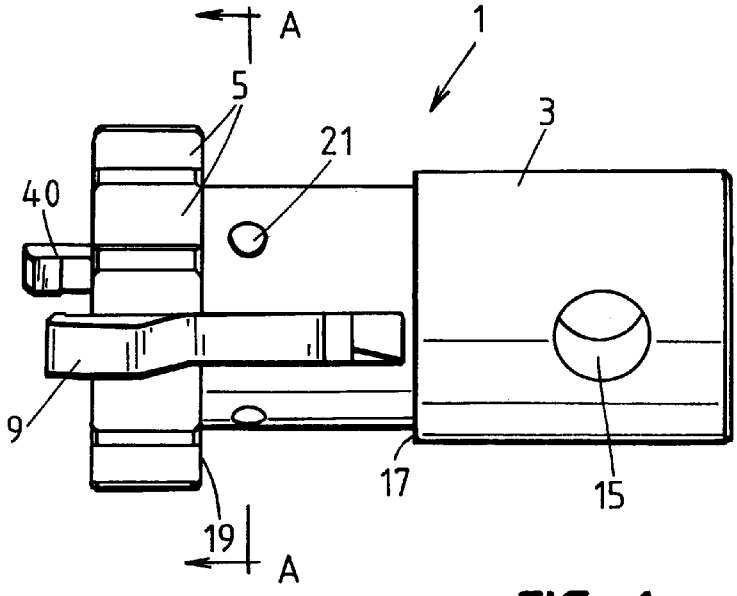
FIG. 1*a* is a side view of a mushroom head constructed in accordance with the teachings of the invention and illustrated without the sleeve.

A mushroom head 1 is shown in a side view in FIG. 1*a*. The mushroom head 1 is formed from an overall cylindrical, elongated shaft 3, having a rear section and a front section. The rear section has a larger diameter than the front section such that an offset 17 is formed therebetween. The rear section of shaft 3 is provided with a transverse hole 15 to accept a control pin (not shown).

A radial rim is formed on the front end of the front section of shaft 3 from locking pins 5 spaced in radial beam-like fashion, whose rear radial surfaces form a front offset 19. The side surfaces of the locking pins 5 lie in planes that extend parallel to the planes that contain the longitudinal center axis 11 of mushroom head 1. The free edges of the locking pins 5 are beveled. The locking pins 5 have the same angular spacing relative to each other. One of these locking pins 5 is missing. An extractor hook 9 extends through the gap.

The extractor hook 9 has a rear section positioned in an elongated groove in the front section of shaft 3. In the region between the two offsets 17, 19, the extractor hook 9 is essentially flush with the outside surface of shaft 3. The rear section of extractor hook 9 can be pivoted around a pivot 21 which it penetrates transversely and which is embedded in shaft 3.

Figure 1B:
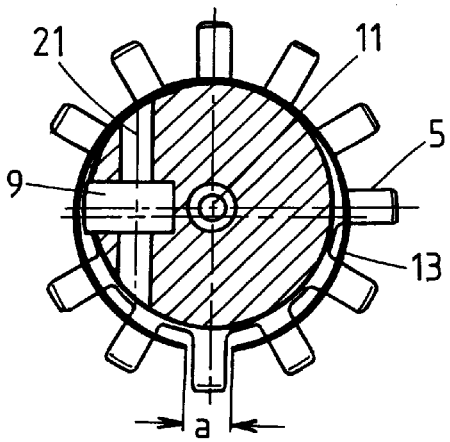
FIG. 1*b* shows a section through the mushroom head along line A—A in FIG. 1*a* with the sleeve illustrated in an expanded, relaxed state.

A compression spring (not shown) inserted into shaft 3 can be provided as an extractor spring beneath the end of extractor hook 9, which extends outward over pivot 21. This spring can be replaced by an elastic sleeve 13 (FIG. 1*b* and 1*c*), which is a circular cylinder made of spring plate having a continuous longitudinal slit. When sleeve 13 is in the relaxed state, this longitudinal slit has a slit width "a" (FIG. 1*b*). The length of sleeve 13 is dimensioned so that it fits between the two offsets 17 and 19.

Figure 1C:
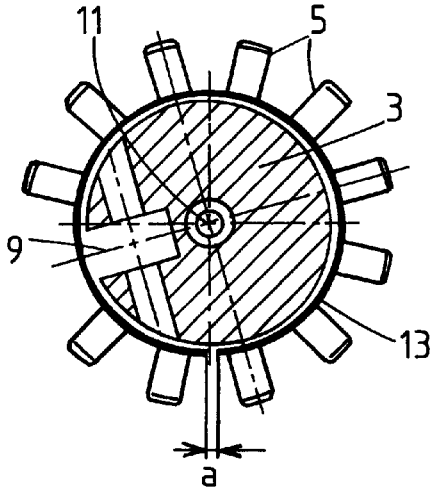
FIG. 1*c* shows a section as in FIG. 1*b*, but with the sleeve radially compressed.

When sleeve 13 is compressed against its spring action such that it lies tightly against the front section of shaft 3, its slit width diminishes to the small value "a" (FIG. 1*c*). In the relaxed state, the inside wall of sleeve 13 lies loosely above the rear section of extractor hook 9.

The sleeve 13, if necessary, prevents the pivot 21 from falling out of the shaft 3.

Removal and insertion of the sleeve 13 is accomplished by simply pushing the sleeve onto the shaft 3 with the breechblock disassembled. More specifically, during assembly the sleeve 13 can be pushed without difficulty over the rear section of shaft 3.

The rear section of shaft 3 (which has a relatively large diameter compared to the front section of that device) extends with limited play into a cavity opened to the front in a breechblock carrier 23. An annular space is defined between the inner surface of the cavity formed in the breechblock carrier 23 and the outer surface of the shaft 3. The carrier is perforated on one side by a longitudinal hole forming a link 27, which extends obliquely to the longitudinal direction and whose width corresponds to the final diameter of a control pin, which is positioned in transverse hole 15.

In the operating position of mushroom head 1, its transverse hole 15 is flush with link 27. The control pin (not shown), which is pushed through the transverse hole 15 and link 27 with very limited play, is guided in, and runs along, link 27 when the mushroom head 1 carries out an axial relative movement with respect to breechblock carrier 23 such that the mushroom head 1 is rotated relative to breechblock carrier 23. The axial distance covered during this motion is defined as the locking distance b (FIG. 2*b*).

A locking element 35 is formed at the end of the barrel with cartridge chamber 29. The locking element widens to the rear so that it forms a sloped surface such as a cone 31 to the rear of the cartridge chamber 29. An inner annular groove 37 is formed between cone 31 and cartridge chamber 29. The axial width of the groove 37 corresponds at least to the axial length of the locking pins 5. The cone has longitudinal grooves 33, whose number, arrangement and design correspond to the locking pins 5 on mushroom head 1.

Figure 2A:
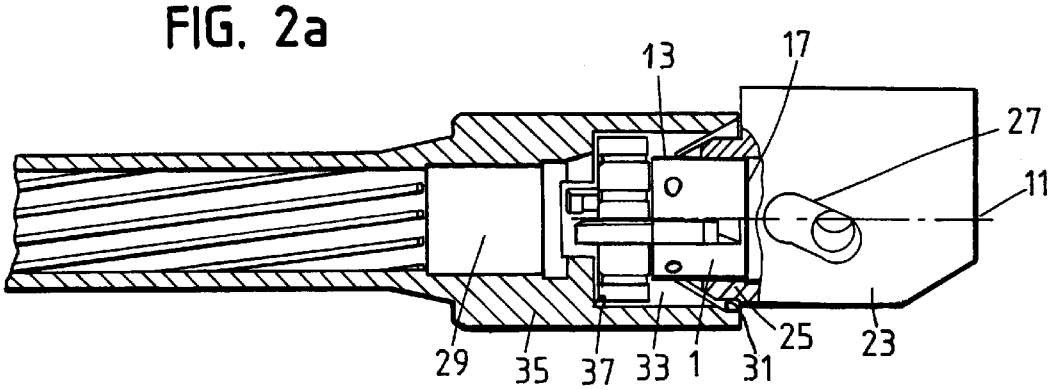
FIG. 2*a* is a reduced longitudinal section view of the rear part of a barrel with a cartridge chamber and a locking element, showing the breechblock in the locked state.
Figure 2B:
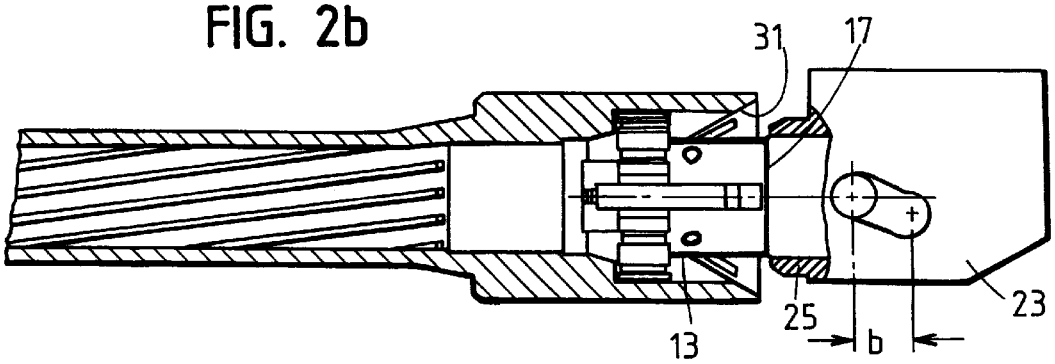
FIG. 2*b* shows a view similar to FIG. 2*a* but illustrating the breechblock in a closed but unlocked state.

When the mushroom head 1 is separated from breechblock carrier 23 by the greatest possible distance (FIG. 2*b* and FIG. 2*c*) and approaches cone 31 from the rear (FIG. 2*c*), the locking pins 5 (and the extractor hook 9) pass precisely through longitudinal grooves 33 until the front end surface of mushroom head 1 stops on the front limitation surface of the inner annular groove 37 or on the bottom of the cartridge (FIG. 2*b*).

If the breechblock carrier 23 now moves forward relative to mushroom head 1 by the locking distance b, the mushroom head 1 is rotated such that the locking pins 5 run along the inner annular groove 37 and engage behind the front end of cone 31 between longitudinal grooves 33. The breechblock is then locked (FIG. 2*a*).

The sleeve 13 ensures that the mushroom head 1 can only be shifted in the longitudinal direction relative to breechblock carrier 23 and, thus, rotated when the mushroom head 1 is situated in its frontmost position (FIG. 2*a* and 2*b*). The breechblock carrier 23 is guided in its motion (not shown) in the weapon housing, so that it cannot rotate around longitudinal center axis 11. When the carrier 23 is displaced rearward relative to mushroom head 1 by the locking distance b, the rear offset 17 of mushroom head 1 is situated in a position in which it is either flush with or protrudes slightly beneath the front end surface of a cylindrical connector 25 located at the forward end of the carrier 23. The cylindrical connector 25 effectively lengthens the breechblock carrier 23 forward.

Figure 2C:
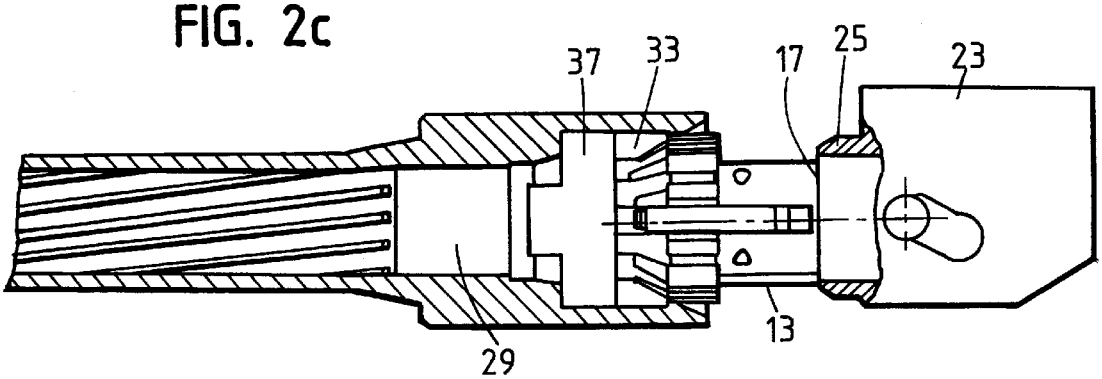
FIG. 2*c* shows a view similar to FIG. 2*a* but illustrating the breechblock in a slightly opened state.
Figure 2D:
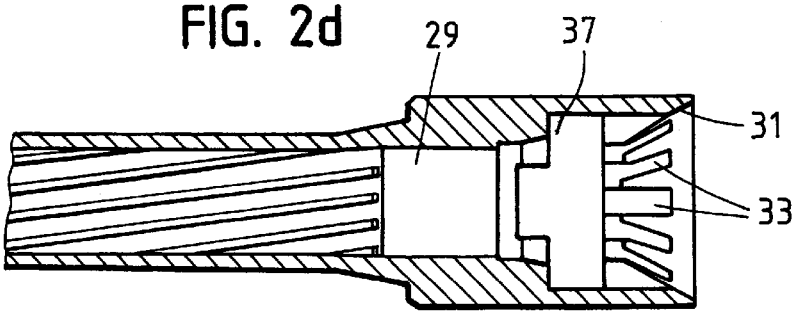
FIG. 2*d* shows the longitudinal section through the rear part of the barrel and the locking element with the breechblock in a fully opened state (therefore, the breechblock is not visible in the drawing).

When the mushroom head 1 is entirely released by locking element 35, the sleeve 13 is free and can expand (FIG. 1*b*). It then assumes an outside diameter greater than the outside diameter of the rear section of mushroom head 1 and, thus, the hole in the breechblock carrier 23, and covers a part of the front end surface of connector 25. An axial relative movement of the mushroom head 1 relative to breechblock carrier 23 is, therefore, not possible in this open breechblock position depicted in FIG. 2*c*, because the sleeve 13 extends between the front offset 19 of mushroom head 1 and the front end surface of connector 25. As a result, the mushroom head 1 cannot be rotated relative to the breechblock carrier 23 when the mushroom head 1 is released from the locking element (FIG. 2*c*)

If the breechblock is reclosed, locking pins 5 initially enter longitudinal grooves 33. The front edge of the expanded sleeve 13 then runs against the region of cone 31 remaining between longitudinal grooves 33. The subsequent forward movement of the breechblock ensures that the sleeve 13 is pushed back into cone 31 and then radially compressed.

At the latest, when the mushroom head 1 runs against the front limitation of inner annular groove 37 or a cartridge bottom, the sleeve 13 is "fully" compressed (FIG. 2*b*). The outside diameter is then smaller than that of the rear section of the shaft 3 of the mushroom head 1 and the breechblock carrier 23 can, therefore, move forward with its hole over sleeve 13, such that the mushroom head 1 is rotated by the interaction of the control pin and the link 27 and the sleeve 13 enters the annular space between the shaft 3 and the inner surface of the breechblock carrier 23. The length section of the sleeve 13 that enters the annular space between the shaft 3 and the carrier 23 corresponds roughly to the locking distance.

If, during closure of the open breechblock, the mushroom head 1 runs with the locking pins 5 against an advancing, rigid cartridge (not shown), the axial force exerted on the mushroom head 1 is then transferred directly via the expanded sleeve 13 to the end surface of the cylindrical connector 25 on the breechblock carrier 23 without causing rotation of the mushroom head 1, which then must be counteracted at another location. In other words, in the expanded state, the sleeve 13 transfers any longitudinal force acting on the mushroom head 1 directly to the breechblock carrier 23, bypassing the automatic control of the weapon.

It should be noted that the extractor hook 9 and the transverse hole 15 of the mushroom head 1 with an open breechblock (FIG. 2*b*, 2*c*) can be situated at precisely the same height as the longitudinal center axis 11 (starting from the normal horizontal stop of the corresponding weapon). It is, therefore, possible to incorporate the mushroom head 1 with either a right-facing or left-facing extractor hook 9 (left-facing is shown in the drawings) and to ensure that after firing a cartridge, the casing is ejected from the weapon either to the right or left. The weapon can, thus, be adapted to right or left shooting. The action of sleeve 13 is unaffected by this adaptation. As shown in FIG. 1*a*, the extractor hook 9 is opposite a protruding tooth 40 with reference to longitudinal center axis 11, which forms a "counterstop" for the cartridge casing.

Preferably, the breechblock carrier 23 is moved by a handle (not shown) or a loading lever and also by a gas piston (not shown) and entrains mushroom head 1 with it during the loading process.

Preferably, the spring plate sleeve 13 has fairly large dimensions (the length corresponds at least to roughly the locking distance). As will be appreciated by those skilled in the art, the sleeve 13 is an extremely uncomplicated component that is easy to manufacture, and whose function during the loading process consists of expanding elastically or being slightly compressed against its spring action. Engagement in snaps or the like does not occur. Wear, therefore, is not an issue. Since the spring path of the sleeve is limited, breakage of the sleeve need not be reckoned with either. The sleeve 13 is preferably formed from a relatively thick sheet. Therefore, since corrosion only affects a small fraction of the material thickness, corrosion of the sleeve 13 does not adversely affect trouble-free action. The sleeve 13 is also advantageous in that it protects the parts of the connection device covered by it from dirt splattering and the like.

In short, persons of ordinary skill in the art will appreciate that an additional, simple sheet part is employed to avoid all of the problems and disturbances mentioned above during the reloading process.

The component or assembly referred to herein as the "connection device" is the structure that keeps the mushroom head 1 and breechblock carrier 23 separated at least by the locking distance in the unlocked state of the breechblock and permits mutual approach of those two components in the locked state. This connection device can be inserted into the mushroom head 1 and/or into the breechblock carrier 23. The connection device, however, can also be lengthened or shortened, for example, in the form of a toggle joint mechanism. In the illustrated embodiment, the connection device is implemented by the shaft 3.

The breechblock carrier 23 can be positioned directly on the mushroom head 1 in the locked state. In this case, in the unlocked state, the spacing between the mushroom head 1 and the carrier 23 corresponds to the locking distance. The axial length of the sleeve 13 advantageously also agrees with the length of the locking distance.

Preferably, the connection device is advantageously designed so that, even in the locked state, a spacing is present between the mushroom head 1 and the breechblock carrier 23, which spacing is then lengthened during unlocking by the locking distance. The sleeve 13 can expediently be dimensioned in length so that in the unlocked state it spans the entire distance between the mushroom head 1 and the breechblock carrier 23 so that, on the occurrence of axial forces, the connection device remains essentially free of forces. During locking, the sleeve 13 enters the annular space by an amount that, at most, corresponds to the locking distance.

Of the possible locking methods, rotary locking is preferred, in which the mushroom head 1 is designed to be rotated around the lengthened axis of the bore of the barrel. In this case, the sleeve 13 preferably loosely surrounds the connection device. The advantage of rotational locking is that essentially symmetric support of the breechblock can be produced with respect to the axis of the bore by simple means so that, during firing, one-sided loads do not act on the barrel, which, among other things, could otherwise adversely affect firing performance.

The loose arrangement of the sleeve 13 means that no special attachments are required for it. Therefore, the tolerance to be maintained for the sleeve 13 can be fairly high.

According to a preferred practical example of the invention, the wall of the cone 31 is cut by longitudinal grooves 33 which form the recesses for entry of the locking pins 5 while the cone 31 is compressing the sleeve 13. It is, therefore, possible to use locking pins 5 arranged in stellate fashion with the advantages inherent to them, but also to ensure at the same time that the sleeve 13 is compressed evenly over its periphery when the breechblock is to be locked. Because of this, local hangup of the sleeve 13 and, thus, a harmful force concentration is avoided. When the breechblock closes by the action of its closure spring, it attains a significant kinetic energy, but could be braked by a jammed sleeve 13, which would result in loading interference.

The connection device is preferably arranged as a shaft-like extensions of the mushroom head 1 which, during locking, enters the breechblock carrier 23 by at least the locking distance. Naturally, the shaft 3 can already extend into the breechblock carrier 23 from the outset so that, during locking, it is only pushed in a telescoping fashion further into the breechblock carrier 23 by the locking distance "b".

Although the annular space is preferably formed in the breechblock carrier 23, persons of ordinary skill in the art will appreciate that other arrangements, including, without limitation, forming the space in the mushroom head 1, could be employed without departing from the scope or spirit of the invention.

Since, on the one hand, the sleeve 13 lies against the cone 31 from the interior under spring tension when the breechblock is locked and since, on the other hand, the sleeve 13 essentially fills up the annular space, the sleeve 13 can form a guide element because it aligns the breechblock carrier 23 independently of the mushroom head 1 on the cone 31 and, thus, on the axis of the barrel bore.

The locking pins 5 of the mushroom head 1 form a front stop for the sleeve 13. The breechblock carrier 23, with its zone radially around the annular space and outside of the annular space, forms a rear stop for the expanded sleeve 13.

As mentioned above, the mushroom head 1 has an extractor hook 9 whose rear part preferably is positioned beneath the sleeve 13. The sleeve 13, thus, not only protects the rear part of the extractor hook 9, but is also supported radially when it executes an arc movement beneath the cartridge edge during unlocking so that reliable holding of the extractor hook 9 on the cartridge bottom is guaranteed. The sleeve 13 can optionally form the spring for the extractor hook.

In summary, a breechblock which can be moved in the longitudinal direction of the barrel of a firearm, and which is formed from a mushroom head and a breechblock carrier has been provided. In the illustrated embodiment, the mushroom head 1 and the breechblock carrier 23 are connected by a connection device that can be pushed into the mushroom head 1 and/or into the breechblock carrier 23. In the locked position, the mushroom head 1 engages behind a locking element which is either rigidly connected to or integrally formed with the rear end of a barrel. During unlocking, the breechblock carrier 23 is initially moved alone backward by a locking distance, in which engagement of the locking element by the mushroom head 1 is released by an automatic control. After unlocking, the mushroom head 1 and breechblock carrier 23 are moved together rearward. The mushroom head 1 and the breechblock carrier are then moved forward while offset from one another by a locking distance for a reloading process. The mushroom head 1 and the breechblock carrier 23 are both moved distally until the mushroom head 1 has again reached its frontmost position, whereupon the breechblock carrier 23 is moved forward alone by the locking distance and the automatic control of the mushroom head 1 causes the mushroom head 1 to rotate into engagement with the locking element.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. For use in a firearm, a breechblock assembly comprising:

a barrel with a locking element at the proximal end of the barrel;

a breechblock carrier;

a mushroom head;

a connecting device operatively coupling the breechblock carrier and the mushroom head; and an elastic sleeve mounted on the connecting device and having an expanded state and a compressed state, the elastic sleeve contacting the breechblock carrier and the mushroom head in the expanded state to thereby substantially prevent relative longitudinal movement between the mushroom head and the breechblock carrier; whereby compression of the sleeve from the expanded state towards the compressed state permits relative longitudinal movement between the breechblock carrier and the mushroom head, and wherein a cone is disposed such that, during closure of the breechblock, entry of the sleeve into the cone compresses the sleeve from the expanded state towards the compressed state.

2. A breechblock assembly as defined in claim 1 wherein the mushroom head and the connecting device define an annular space, and the sleeve is sized to enter the annular space when suitably compressed by the cone to permit relative longitudinal movement between the mushroom head and the breechblock carrier.

3. A breechblock assembly as defined in claim 1 wherein the breechblock carrier and the connecting device define an annular space, and the sleeve is sized to enter the annular space when suitably compressed by the cone to permit relative longitudinal movement between the mushroom head and the breechblock carrier.

4. A breechblock assembly as defined in claim 1 wherein the sleeve comprises spring plate.

5. A breechblock assembly as defined in claim 1 wherein the sleeve includes a slit to permit compression between the expanded state and the compressed state.

6. A breechblock assembly as defined in claim 1 wherein the mushroom head is coupled to the breechblock carrier via a control pin riding in a link extending obliquely to a longitudinal axis of the breechblock carrier such that, relative longitudinal movement between the mushroom head and the breechblock carrier causes the mushroom head to rotate relative to the breechblock carrier.

7. A breechblock assembly as defined in claim 6 wherein rotating the mushroom head in a first direction locks the mushroom head behind the locking element, and rotating the mushroom head in a second direction opposite the first direction releases the mushroom head from the locking element.

8. A breechblock assembly as defined in claim 6 wherein the mushroom head includes a plurality of locking pins sized and spaced to engage the locking element when the mushroom head is in a locked position.

9. A breechblock assembly as defined in claim 8 wherein the cone includes a plurality of longitudinal grooves for receiving the locking pins as the mushroom head is inserted and removed from the barrel.

10. A breechblock assembly as defined in claim 6 wherein the sleeve prevents rotation of the mushroom head relative to the breechblock carrier when the sleeve is in the expanded state.

11. A breechblock assembly as defined in claim 10 wherein the mushroom head can only be rotated relative to the breechblock carrier when the mushroom head is inserted a predetermined distance into the cone such that the sleeve has compressed sufficiently to permit longitudinal relative movement between the mushroom head and the breechblock carrier.

12. A breechblock assembly as defined in claim 6 wherein the mushroom head engages behind the locking element in a locked position.

13. A breechblock assembly as defined in claim 12 wherein the breechblock assembly is unlocked by first proximally moving the breechblock carrier alone by a locking distance during which the mushroom head is rotated out of the locked position; and by thereafter moving the breechblock carrier and the mushroom head proximally together thereby causing the sleeve to move from the compressed state towards the expanded state.

14. A breechblock assembly carrier as defined in claim 13 wherein when the sleeve is in the expanded state, the mushroom head and breechblock carrier can be moved distally against a cartridge to reload without causing relative longitudinal movement between the mushroom head and the breechblock carrier.

15. A breechblock assembly carrier as defined in claim 13 wherein the breechblock is locked by first moving the breechblock carrier and the mushroom head together distally until the mushroom head reaches its distalmost position, and by subsequently moving the breechblock carrier distally by a locking distance such that the mushroom head rotates behind the locking element.

16. A breechblock assembly as defined in claim 1 wherein the connecting device comprises a shaft rigidly coupled to the mushroom head.

17. A breechblock assembly as defined in claim 16 wherein the shaft is integral to the mushroom head.

18. A breechblock assembly as defined in claim 16 wherein an extractor hook is coupled to the shaft, and the extractor hook includes a proximal section which is enclosed by the sleeve.

19. A breechblock assembly as defined in claim 1 wherein the amount of relative longitudinal movement between the mushroom head and the breechblock carrier defines a locking distance, and the sleeve is longer than the locking distance.

20. A breechblock assembly as defined in claim 1 wherein the sleeve loosely surrounds the connecting device.

21. A breechblock assembly as defined in claim 1 wherein the cone is disposed at the proximal end of the barrel.

22. For use in a firearm having a barrel and a locking element formed at a proximal end of the barrel, a breechblock comprising:

a breechblock carrier;

a mushroom head;

a connecting device operatively coupling the breechblock carrier and the mushroom head; and an elastic sleeve mounted on the connecting device and having an expanded state and a compressed state, the elastic sleeve contacting the breechblock carrier and the mushroom head in the expanded state to thereby substantially prevent relative longitudinal movement between the mushroom head and the breechblock carrier; whereby compression of the sleeve from the expanded state towards the compressed state permits relative longitudinal movement between the breechblock carrier and the mushroom head, wherein the mushroom head is coupled to the breechblock carrier via a control pin riding in a link extending obliquely to a longitudinal axis of the breechblock such that, relative longitudinal movement between the mushroom head and the breechblock carrier causes the mushroom head to rotate relative to the breechblock carrier.

23. A breechblock as defined in claim 22 wherein rotating the mushroom head in a first direction locks the mushroom head behind the locking element, and rotating the mushroom head in a second direction opposite the first direction releases the mushroom head from the locking element.

24. A breechblock as defined in claim 22 wherein the mushroom head includes a plurality of locking pins sized and spaced to engage the locking element when the mushroom head is in a locked position.

25. A breechblock as defined in claim 22 wherein the sleeve prevents rotation of the mushroom head relative to the breechblock carrier when the sleeve is in the expanded state.

26. A breechblock as defined in claim 25 wherein the mushroom head can only be rotated relative to the breechblock carrier when the mushroom head is inserted a predetermined distance into the barrel such that the sleeve has compressed sufficiently to permit longitudinal relative movement between the mushroom head and the breechblock carrier.

27. A breechblock as defined in claim 22 wherein the mushroom head is adapted to engage behind the locking element in a locked position.

28. A breechblock as defined in claim 27 wherein the breechblock is unlocked by first proximally moving the breechblock carrier alone by a locking distance during which the mushroom head is rotated out of the locked position; and by thereafter moving the breechblock carrier and the mushroom head proximally together thereby causing the sleeve to move from the compressed state towards the expanded state.

29. A breechblock assembly as defined in claim 28 wherein when the sleeve is in the expanded state, the mushroom head and breechblock carrier can be moved distally against a cartridge to reload without causing relative longitudinal movement between the mushroom head and the breechblock carrier.

30. A breechblock assembly as defined in claim 28 wherein the breechblock is locked by first moving the breechblock carrier and the mushroom head together distally until the mushroom head reaches its distalmost position, and by subsequently moving the breechblock carrier distally by a locking distance such that the mushroom head rotates behind the locking element.

31. For use in a firearm having a barrel and a locking element formed at a proximal end of the barrel, a breechblock comprising:

a breechblock carrier;

a mushroom head;

a connecting device operatively coupling the breechblock carrier and the mushroom head; and an elastic sleeve mounted on the connecting device and having an expanded state and a compressed state, the elastic sleeve contacting the breechblock carrier and the mushroom head in the expanded state to thereby substantially prevent relative longitudinal movement between the mushroom head and the breechblock carrier; whereby compression of the sleeve from the expanded state towards the compressed state permits relative longitudinal movement between the breechblock carrier and the mushroom head, wherein the connecting device comprising a shaft rigidly coupled to the mushroom head and an extractor hook coupled to the shaft, and wherein the extractor hook includes a proximal section which is enclosed by the sleeve.

32. A firearm comprising:

a barrel;

a locking element at a proximal end of the barrel;

a breechblock carrier;

a mushroom head having a plurality of locking pins sized and spaced to engage the locking element when the mushroom head is in a locked position;

a connecting device operatively coupling the breechblock carrier and the mushroom head; and an elastic sleeve mounted on the connecting device and having an expanded state and a compressed state, the elastic sleeve contacting the breechblock carrier and the mushroom head in the expanded state to thereby substantially prevent relative longitudinal movement between the mushroom head and the breechblock carrier; whereby compression of the sleeve from the expanded state towards the compressed state permits relative longitudinal movement between the breechblock carrier and the mushroom head, wherein the mushroom head is coupled to the breechblock carrier via a control pin riding in a link extending obliquely to a longitudinal axis of the breechblock such that, relative longitudinal movement between the mushroom head and the breechblock carrier causes the mushroom head to rotate relative to the breechblock carrier, wherein the barrel includes a plurality of longitudinal grooves for receiving the locking pins as the mushroom head is inserted and removed from the barrel.

* * * * *